US007450885B2

(12) United States Patent
Kim et al.

(10) Patent No.: US 7,450,885 B2
(45) Date of Patent: Nov. 11, 2008

(54) ELECTROPHOTOGRAPHIC TYPE IMAGE FORMING APPARATUS AND ITS DRIVING METHOD

(75) Inventors: Young-min Kim, Suwon-si (KR); Sang-cheol Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 71 days.

(21) Appl. No.: 11/088,991

(22) Filed: Mar. 24, 2005

(65) Prior Publication Data

US 2005/0214029 A1 Sep. 29, 2005

(30) Foreign Application Priority Data

Mar. 24, 2004 (KR) ..... 10-2004-0019897

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS

| | | | | | |
|---|---|---|---|---|---|
| 4,338,880 | A | * | 7/1982 | Tabuchi et al. | 399/103 |
| 5,126,800 | A | * | 6/1992 | Shishido et al. | 399/167 X |
| 5,206,696 | A | | 4/1993 | Hirobe et al. | |
| 5,666,597 | A | * | 9/1997 | Sasame et al. | 399/167 X |
| 5,719,684 | A | * | 2/1998 | Ohkaji et al. | 358/300 |
| 2002/0098013 | A1 | * | 7/2002 | Kamimura | 399/167 |
| 2005/0158077 | A1 | * | 7/2005 | Kwon | 399/167 |

FOREIGN PATENT DOCUMENTS

| | | | |
|---|---|---|---|
| JP | 01200379 | A * | 8/1989 |
| JP | 02181760 | A * | 7/1990 |
| JP | 05-268442 | | 10/1993 |
| JP | 06-051576 | | 2/1994 |
| JP | 07-020761 | | 1/1995 |
| JP | 09-114165 | | 5/1997 |
| JP | 10-078090 | | 3/1998 |
| JP | 10-232556 | | 9/1998 |
| JP | 2000075693 | A * | 3/2000 |
| JP | 2000250297 | A * | 9/2000 |
| KR | 1999-018447 | | 3/1999 |
| KR | 10-2001-0027254 | | 4/2001 |

* cited by examiner

*Primary Examiner*—David M Gray
*Assistant Examiner*—Erika J. Villaluna
(74) *Attorney, Agent, or Firm*—Staas & Halsey LLP

(57) ABSTRACT

A driving method of an electrophotographic type image forming apparatus is provided. The method includes forming an electrostatic latent image by operating a photoconductor and an exposure unit, developing the electrostatic latent image by operating a developing unit, and transferring the developed image to a paper, wherein the operation of the developing unit is stopped after a tail end of the electrostatic latent image passes through the developing nip. In addition, the operation of the developing unit is started at a predetermined time between the time when the paper begins to be transmitted and the time when a leading end of the electrostatic latent image reaches the developing nip.

6 Claims, 4 Drawing Sheets

ELECTROPHOTOGRAPHIC TYPE IMAGE FORMING APPARATUS AND ITS DRIVING METHOD

CROSS-REFERENCE TO RELATED APPLICATION

This application claims the benefit of Korean Patent Application No. 2004-19897, filed on Mar. 24, 2004, in the Korean Intellectual Property Office, the disclosure of which is incorporated herein in its entirety by reference.

BACKGROUND OF THE INVENTION

1. Field of the Invention

The present invention relates to an image forming apparatus and its driving method, and more particularly, to an electrophotographic type image forming apparatus and its driving method.

2. Description of the Related Art

In general, an electrophotographic type image forming apparatus is an apparatus for forming an image by charging a photoconductor with a uniform electric potential (a charging step), performing a light scanning operation on the photoconductor to form a desired electrostatic latent image (an exposing step), supplying toner to the electrostatic latent image to develop the electrostatic latent image (a developing step), transferring the developed image to a paper (a transferring step), and fusing the developed image to a paper (a fusing step).

The electrophotographic type image forming apparatus includes a charger for charging the photoconductor, such as a photoconductive drum, with a uniform electric potential, an exposure unit for scaning light modulated according to image data onto the photoconductor to form an electrostatic latent image, a developing unit for supplying toner to the electrostatic latent image to develop the electrostatic latent image, and a transferring unit for transferring the developed image to a paper. The developing unit includes a developing roller which faces the photoconductor, a supplying roller which supplies toner to the developing roller, and an agitator.

During a charging-exposing-transferring-fusing process, the photoconductive drum, the developing roller, the supplying roller, and the agitator rotate at a fixed speed. When the developing roller, the supplying roller, and the agitator rotate, friction occurs between toner particles themselves, and between the toner particles and the developing roller, the supplying roller, the agitator, and a housing of the developing unit. The friction causes abrasion of the toner itself, and damage to the toner persistently. The toner is a compound of base resin, a pigment and an internal or external additive. The internal or external additive regulates electrical or thermal characteristics of the toner. The abrasion and damage of the toner causes the internal and external additives to malfunction. In particular, the abrasion and damage of the toner may cause the external additive to be separated from the toner, whereby the external additive fails to work properly. Deterioration in characteristic of the toner causes degradation in the developing performance, resulting in increasing of toner consumption. In addition, the deterioration in characteristic of the toner causes the toner to stick to the fuser.

SUMMARY OF THE INVENTION

Additional aspects and/or advantages of the invention will be set forth in part in the description which follows and, in part, will be obvious from the description, or may be learned by practice of the invention.

The present invention provides an electrophotographic type image forming apparatus and its driving method capable of minimizing deterioration in characteristic of toner by reducing damage to the toner in an image forming process.

According to an aspect of the present invention, there is provided a driving method of an electrophotographic type image forming apparatus, the method comprising: providing a photoconductor, an exposure unit which forms an electrostatic latent image on the photoconductor, a developing unit which faces the photoconductor and forms a developing nip for supplying toner to the electrostatic latent image, and a transferring unit which faces the photoconductor and forms a transfer nip; forming the electrostatic latent image by operating the exposure unit; developing the electrostatic latent image by operating the developing unit; and transferring the developed image to a paper by supplying the paper to the transfer nip when a leading end of the developed image reaches the transfer nip, wherein the operation of the developing unit is stopped after a tail end of the electrostatic latent image passes through the developing nip.

According to another aspect of the present invention, there is provided a driving method of an electrophotographic type image forming apparatus comprising: providing a photoconductor, an exposure unit which forms an electrostatic latent image on the photoconductor, a developing unit which faces the photoconductor and forms a developing nip for supplying toner to the electrostatic latent image, and a transferring unit which faces the photoconductor and forms a transfer nip; forming the electrostatic latent image by operating the exposure unit; developing the electrostatic latent image by operating the developing unit; and transferring the developed image to a paper by supplying the paper to the transfer nip when a leading end of the developed image reaches the transfer nip, wherein the developing unit starts to operate at a predetermined time from the time when the paper begins to be transmitted to the time when a leading end of the electrostatic latent image reaches the developing nip.

According to another aspect of the present invention, there is provided an electrophotographic type image forming apparatus including a photoconductor, an exposure unit which forms an electrostatic latent image on the photoconductor, a developing unit which faces the photoconductor and forms a developing nip for supplying toner to the electrostatic latent image, and a transferring unit which faces the photoconductor and forms a transfer nip, the apparatus comprising: a motor; and an interrupting element which delivers driving force of the motor to the developing unit selectively, wherein the interrupting element intercepts the driving force transmitted from the motor to the developing unit after a tail end of the electrostatic latent image passes through the developing nip.

According to an aspect of the present invention, there is provided a driving method of an image forming apparatus having a photoconductor, an exposure unit which forms an electrostatic latent image on the photoconductor, a developing unit which faces the photoconductor and forms a developing nip for supplying toner to the electrostatic latent image, and a transferring unit which faces the photoconductor and forms a transfer nip, the method comprising: receiving a printing start command; performing pre-rotation process before starting to form an image; performing the electrostatic latent image by operating the exposure unit; starting to operate the developing unit after performing the pre-rotation process; applying developing bias to the developing roller; developing the electrostatic latent image; and transferring the developed image to a paper.

The interrupting element may deliver the driving force of the motor to the developing unit at a predetermined time from the time when the paper begins to be transmitted to the time when a leading end of the electrostatic latent image reaches the developing nip.

BRIEF DESCRIPTION OF THE DRAWINGS

These and/or other aspects and advantages of the invention will become apparent and more readily appreciated from the following description of the embodiments, taken in conjunction with the accompanying drawings of which.

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
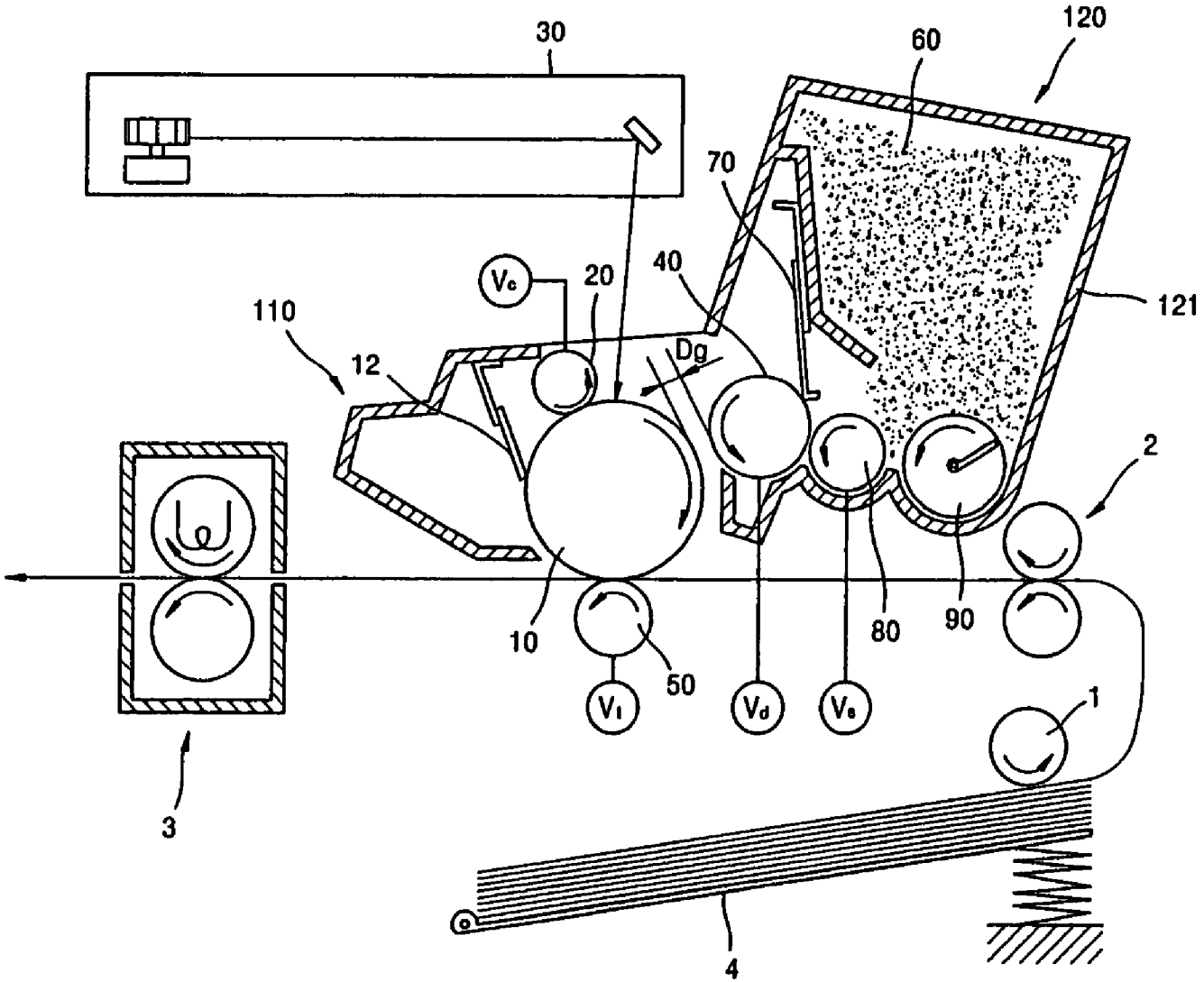
FIG. 1 is a diagram showing an embodiment of an electrophotographic type image forming apparatus according to the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Exemplary embodiments according to the present invention will now be described in detail with reference to the accompanying drawings. Like reference numerals in the drawings denote like elements.

FIG. 1 is a diagram showing an embodiment of an electrophotographic type image forming apparatus according to the present invention. The apparatus includes a photoconductive drum 10, a charging roller 20, an exposure unit 30, a developing roller 40, and a transfer roller 50.

The photoconductive drum 10 is an example of a photoconductor, and has a structure that a photoconductive layer of predetermined thickness is formed on an outer circumferential surface of a cylindrical metal pipe. A photoconductive belt may be used as the photoconductor.

The charging roller 20 is in contact with the photoconductive drum 10 and an example of a charger for charging a surface of the photoconductive drum 10 with a uniform electric potential. A charging bias Vc is applied to the charging roller 20. A corona charger (not shown) may be used instead of the charging roller 20.

The exposure unit 30 forms an electrostatic latent image by scanning light corresponding to image information onto the photoconductive drum 10 charged with a uniform electric potential. In general, a laser scanning unit (LSU), which uses a laser diode as a light source, is used as the exposure unit 30.

The developing roller 40 faces the photoconductive drum 10. A developing bias Vd is applied to the developing roller 40. Toner in a toner container 60 is attached to a surface of the developing roller 40, migrates to the developing nip where the photoconductive drum 10 and the developing roller 40 face each other, and attached to the electrostatic latent image formed on the photoconductive drum 10 by the developing bias Vd. It is preferable that the developing roller 40 has a higher peripheral velocity than the photoconductive drum 10. It is preferable that a peripheral velocity of the developing roller 40 is approximately 1.05 to 1.5 times greater than the photoconductive drum 10. Reference numeral 70 denotes regulating means for regulating amount of the toner attached to the surface of the developing roller 40. Reference numeral 80 denotes a supplying roller for supplying the toner in the toner container 60 to the developing roller 40. Reference numeral 90 denotes an agitator. The image forming apparatus according to the present embodiment employs a non-contact type developing method. Therefore, the developing roller 40 is separated from the photoconductive drum 10 by a developing gap Dg. A supplying bias Vs is applied to the supplying roller 80 in order to attach the toner to the developing roller 40.

The transfer roller 50, an example of a transferring unit, faces the photoconductive drum 10 and forms a transfer nip. A transfer bias Vt is applied to the transfer roller 50 in order to transfer the toner image, which is attached to the photoconductive drum 10, to a paper. A corona transferring unit may be used instead of the transfer roller 50. Reference numeral 12 denotes a cleaning blade for removing the toner, which is not transferred to the paper and remains on the surface of the photoconductive drum 10.

Reference numerals 110 and 120 denote a photoconductive unit 110 and a developing unit 120, respectively. The image forming apparatus according to an aspect of the present embodiment comprises a process cartridge having the photoconductive unit 110 and the developing unit 120 which are integrally combined.

As the developing unit 120 operates, characteristic of the toner in the toner container 60 deteriorates persistently due to friction between toner particles themselves, and between the toner particles and the developing roller 40, the supplying roller 80, the agitator 90, and a housing 121. The deterioration in characteristic of the toner is almost proportional to operating time of the developing unit 120. The electrophotographic type image forming apparatus and its driving method according to an aspect of the present invention minimizes the deterioration in characteristic of the toner by minimizing the operating time of the developing unit 120 in a sequential charging-exposing-developing-transferring process of forming an image. In order to minimize the operating time of the developing unit 120, the apparatus comprises an interrupting element 140 for selectively interrupting driving force of the motor 130 which is delivered to the developing unit 120.

Figure 2:
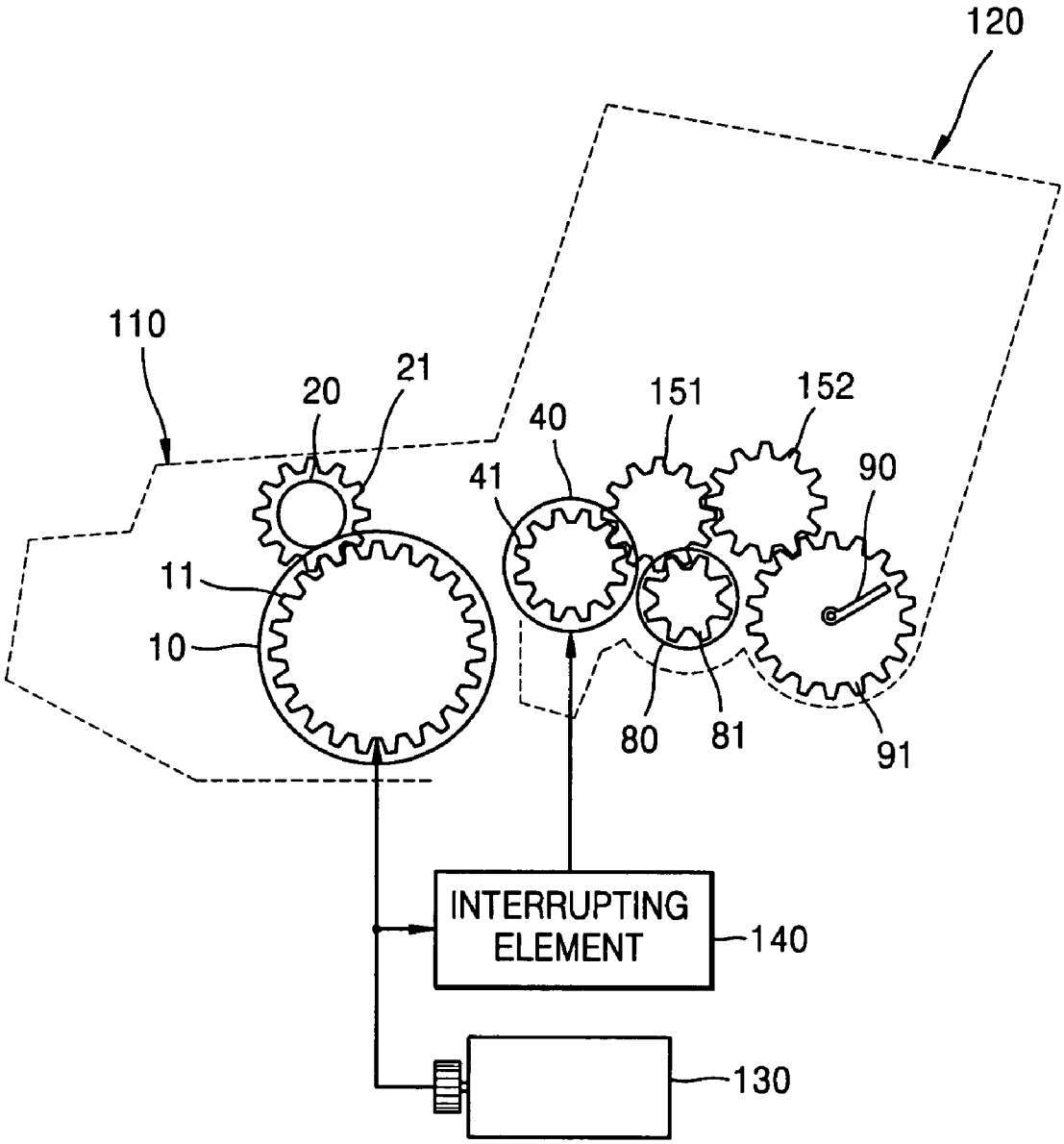
FIG. 2 is a diagram showing an example of a driving apparatus for operating a photoconductive unit and a developing unit.

FIG. 2 shows the motor 130 which operates the photoconductive unit 110 and the developing unit 120. The interrupting element 140 intervenes between the motor 130 and the developing unit 120. The driving force of the motor 130 is delivered to a gear 11 to rotate the photoconductive drum 10. A gear 21 coupled with the charging roller 20 is connected to the gear 11, whereby the photoconductive drum 10 and the charging roller 20 rotate together. The driving force of the motor 130 is delivered to a gear 41 through the interrupting element 140 to rotate the developing roller 40. A gear 81 coupled with the supplying roller 80 and a gear 91 coupled with the agitator 90 are connected to the gear 41 through idle gears 151 and 152, respectively, whereby the developing roller 40, supplying roller 80, and agitator 90 rotate together. An electronic clutch may be used as the interrupting element 140. In addition to the electronic clutch, any means that can selectively deliver/intercept the driving force of the motor 130 can be used as the interrupting element 140.

Figure 3:
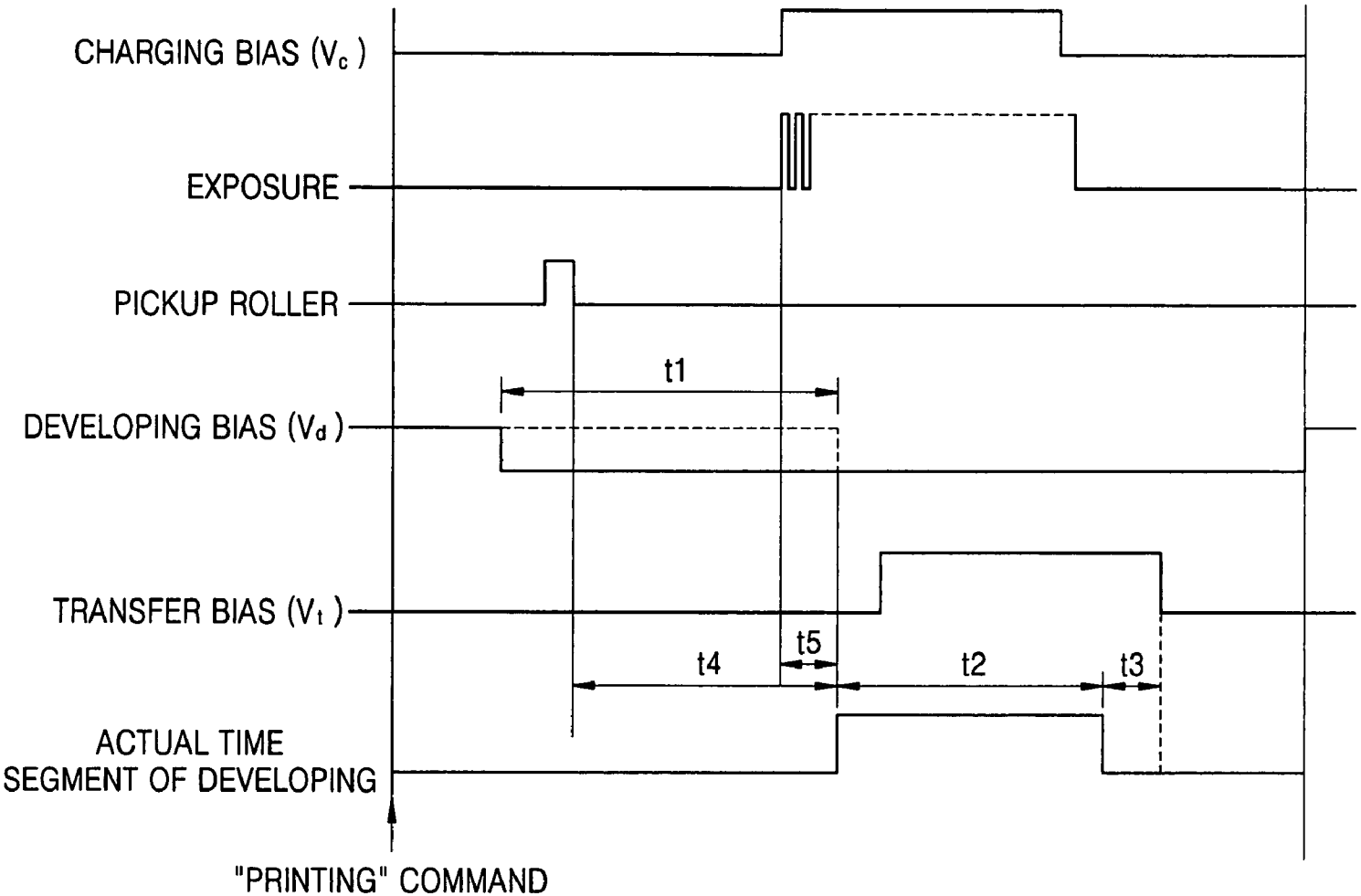
FIG. 3 is a timing chart showing an embodiment of a driving method of an electrophotographic type image forming apparatus according to the present invention.

FIG. 3 is a timing chart showing an embodiment of a driving method of an electrophotographic type image forming apparatus according to the present invention.

When a host computer (not shown) sends a "printing" command to the image forming apparatus, the motor 130 starts to rotate. The driving force of the motor 130 is delivered to the photoconductive unit 110, whereby the photoconductive drum 10 and the charging roller 20 rotate together. The interrupting element 140 delivers the driving force of the motor 130 to the developing unit 120, whereby the developing roller 40, the supplying roller 80, and the agitator 90 rotate together.

A charging bias Vc is applied to the charging roller 20 so that the photoconductive drum 10 can be charged with a uniform electric potential. In the present embodiment, the photoconductive drum 10 is charged with a negative potential. The exposure unit 30 scans light modulated according to image information on the photoconductive drum 10. In a portion of the photoconductive drum 10 which is subject to the light scanning operation, electric charges attached on an outer circumferential surface of the photoconductive drum 10 reduce due to decrease in resistance of the portion. Therefore, the portion of the photoconductive drum 10 which is subject to the light scanning operation is high in potential as compared with a portion which is not subject to the light scanning operation. The difference in potential causes the electrostatic latent image to be formed on the outer circumferential surface of the photoconductive drum 10.

A developing bias Vd is applied to the developing roller 40. The developing bias Vd is applied at a predetermined time in a time segment t1, from the time when the "printing" command is inputted to the time when a leading end of the electrostatic latent image reaches the developing nip. In the present embodiment, the toner is charged with a negative potential. By the developing bias Vs, the toner charged with a negative potential, which is attached to the developing roller 40, is attached to the electrostatic latent image in a relatively high potential across a developing gap Dg, whereby a toner image is formed on the photoconductive drum 10. As the photoconductive drum 10 rotates, the toner image proceeds to the transfer nip.

A paper drawn out from loading unit 4 by a pickup roller 1 is transmitted to the transfer nip by a transmitting roller 2. A pickup starting time of the pickup roller 1 is determined so that a leading end of the paper can reach the transfer nip when a leading end of the toner image on the photoconductive drum 10 reaches the transfer nip.

A transfer bias Vt is applied to the transfer roller 50 a while before or when the leading ends of the paper and the toner image reach the transfer nip. The toner image is transferred to the paper by the transfer bias Vt. After a tail end of the toner image passes through the transfer nip, the transfer bias Vt turns off.

The toner image transferred to the paper is fused to the paper by heat and pressure from a fuser 3. As a result, the image forming process is completed.

In the aforementioned image forming process, a time segment t2 for actually performing the developing step is from the time when the leading end of the electrostatic latent image reaches the developing nip to the time when the tail end of the electrostatic latent image passes through the developing nip. Therefore, after the tail end of the electrostatic latent image passes through the developing nip, the developing unit 120 does not need to operate any more. In the driving method according to the present embodiment, the developing unit 120 stops operating in a time segment t3 from the time when the tail end of the electrostatic latent image passes through the developing nip to the time when the tail end of the developed toner image reaches the transfer nip. The interrupting element 140 intercepts driving force of the motor 130. Therefore, by stopping operation of the developing unit 120 as soon as the developing step is completed, it is possible to minimize the deterioration in characteristic of the toner due to friction between toner particles themselves, and between the toner particles and the developing roller 40, supplying roller 80, agitator 90, and housing 121.

When a "printing" command is inputted, the image forming apparatus is subject to a pre-rotation process before starting to form an image. The pre-rotation process, for instance, includes a preparing step for the image formation in which the toner remaining on an outer circumferential surface of the photoconductive drum 10 is removed while the photoconductive drum 10 is rotating. In addition, the pre-rotation process may further include a step of determining an optimum transfer bias Vt for environmental factors such as temperature and humidity by applying voltage to the transfer roller 50 and measuring current flowing through the transfer nip to the photoconductive drum 10. It is preferable not to operate the developing unit 120 or reduce the operating time of the developing unit 120 as greatly as possible since the developing step is not performed during the pre-rotation process.

In addition, according to an aspect of the invention, it is preferable that the developing unit 120 starts to operate in a time segment t4 from the time when the paper is drawn out from the loading unit 4 to the time when the electrostatic latent image reaches the developing nip. In this case, even though the motor 130 rotates after a "printing" command is inputted, the interrupting element 140 intercepts power connection between the motor 130 and the developing unit 120, and delivers driving force of the motor 130 to the developing unit 120 at a predetermined time in the time segment t4. In this case, the developing unit 120 may operate when the electrostatic latent image reaches the developing nip. Actually, the toner in the toner container 60 is attached to the outer circumferential surface of the developing roller 40 and supplied to the developing nip when the leading end of the electrostatic latent image reaches the developing nip. Therefore, it is preferable that the developing unit 120 starts to operate a while before the leading end of the electrostatic latent image reaches the developing nip.

Figure 4:
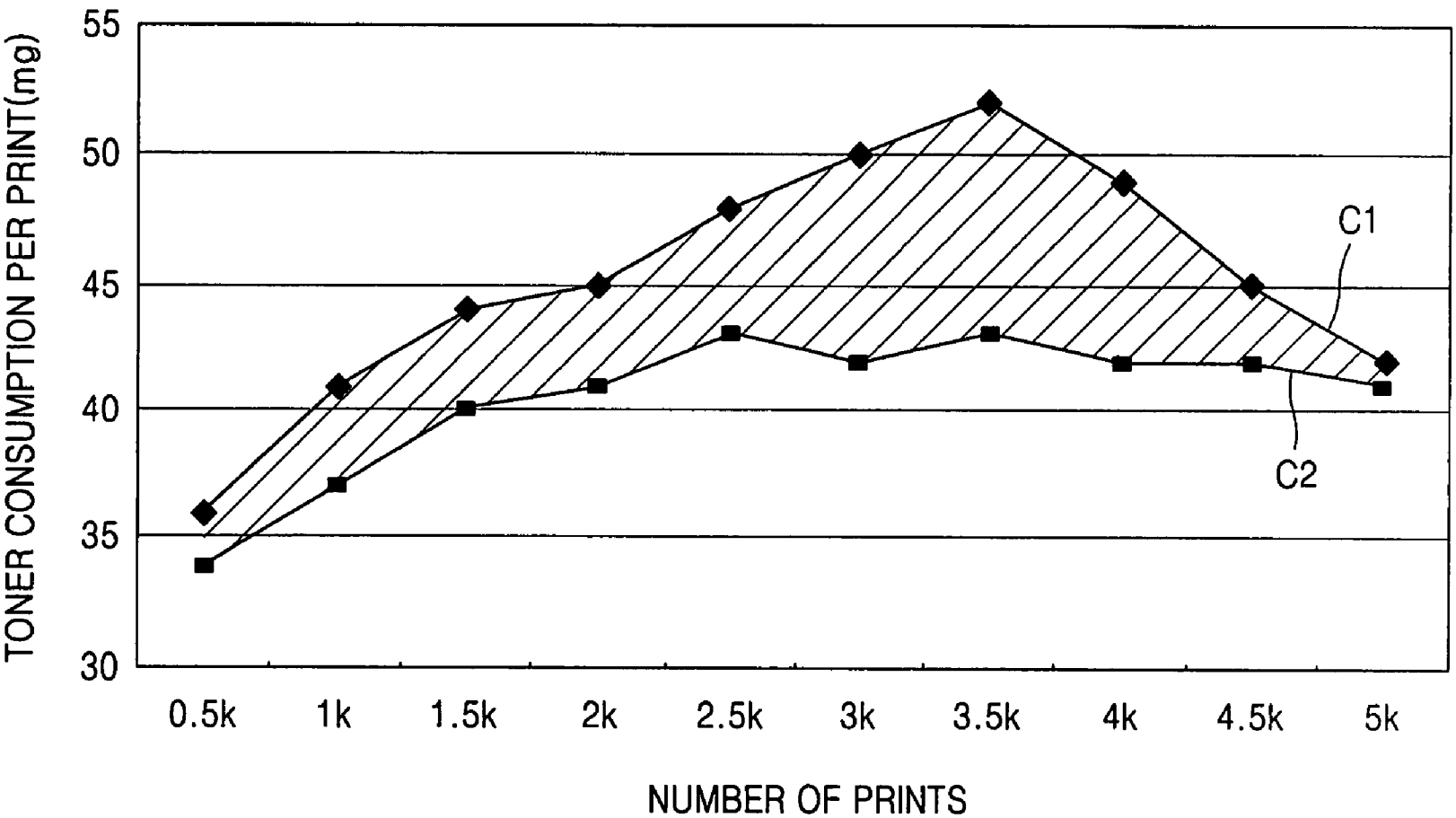
FIG. 4 is a graph showing the relation between printing amount and toner consumption.

FIG. 4 is a graph showing the relation between printing amount and toner consumption in the electrophotographic type image forming apparatus and its driving method according to the present invention.

The photoconductive drum 10 is 30 mm in diameter, and the photoconductive layer is 15-40 μm in thickness. The toner is composed of polyester resin and additives such as carbon black, polyprophylene, iron oxide, amorphous silica, and organic pigment, and 7-10 μm in average diameter. A standard charging bias Vc, a standard supplying bias Vs, a standard developing bias Vd, and a standard transfer bias Vt are −1.6 KV(DC), −500V(DC), −650V(DC), and 1 KV(DC), respectively. The charging roller 20 is a urethane-coated roller, 12 mm in diameter, and has a resistance of 1 MΩ in applying a voltage of 500V(DC). The supplying roller 80 is a silicon foam roller, and has a resistance of 1 MΩ in applying a voltage of 500V(DC). The developing roller 40 is a urethane roller, 20 mm in diameter, and has a resistance of 10-100 MΩ in applying a voltage of 500V(DC). The transfer roller 50 is an NBR foam roller, 18 mm in diameter, and has a resistance of 100-1000 MΩ in applying a voltage of 500V(DC).

A process speed, a transmitting speed of the paper, is 123 mm/sec. A 5% coverage standard pattern is printed. The printing paper is a typical A4-sized paper. The developing bias is applied during the same time segment as an actual developing period. The developing unit 120 starts to operate 0.2 sec before the developing bias is applied, and the developing unit 120 stops operating 0.05 sec after the actual developing period is ended.

In FIG. 4, the horizontal axis of the graph indicates the number of prints, and the vertical axis indicates toner consumption (mg) per print. Curves C1 and C2 represent a case of not applying the driving method according to the present embodiment and a case of applying the driving method according to the present embodiment, respectively.

As the number of prints increases, the toner consumption increases. The operating time of the developing unit 120 increases as the number of printing papers increases. Thus, the toner does not function properly due to deterioration in characteristic of the toner. When the number of prints is over 3,500 sheets, characteristics of each component of the developing unit 120 and the toner are deteriorated. As a result, since the developing step is not properly performed, the toner consumption decreases.

In the curve C1, an initial minimum consumption of toner is about 36 mg, and the maximum consumption is about 52 mg when the number of prints is about 3,500 sheets. In the curve C2, an initial minimum consumption of toner is about 34 mg, and the maximum consumption is about 43 mg when the number of prints is about 3,500 sheets. The ratio of maximum consumption to minimum consumption is about 144% in case of the curve C1, and about 126% in case of the curve C2.

In the driving method according to the present invention, the toner consumption increases gently as the number of prints increases, thus, the toner consumption is uniform. Therefore, according to the present invention, it is possible to minimize the deterioration in characteristic of toner. In addition, it is possible to reduce the deterioration in characteristic of each component of the developing unit 120 by minimizing the operating time of the developing unit 120. The areas defined by the curve C1 and the horizontal axis and the curve C2 and the horizontal axis represent total amount of toner consumed in the entire printing process. In the driving method according to the present invention, the toner consumption reduces by amount of the toner corresponding to the area between the curve C1 and the curve C2. In the driving method according to the present invention, the toner consumption reduces by about 20% as compared with different driving methods. Therefore, it is possible to improve durability of the process cartridge by 20% since more printing is possible with the same amount of toner. In addition, it is possible to improve print quality of an image by reducing the deterioration in characteristic of each component of the developing unit 120. In addition, it is possible to improve fusing performance by preserving characteristics of additives related to the fusing performance.

The aforementioned embodiments of the present invention have been described concerning an image forming apparatus and its driving method using a non-contact type developing method in which the developing roller 40 is separated from the photoconductive drum 10 by the developing gap Dg. However, the present invention is not limited by the developing method. The electrophotographic type image forming apparatus and its driving method according to the present invention can adapt to an image forming apparatus and its driving method using a contact type developing method in which the developing roller 40 is in contact with the photoconductive drum 10. In the contact type developing method, a peripheral velocity of the developing roller 40 is about 1.05-1.5 times greater than the photoconductive drum 10. In the contact type developing method, since the developing roller 40 rotates at a speed different from the photoconductive drum 10 while the developing roller 40 is in contact with the photoconductive drum 10 under a predetermined pressure, the toner experiences more serious damage. Therefore, in the driving method according to the present invention, it is possible to reduce the deterioration in characteristic of toner more effectively.

While the aforementioned embodiments of the present invention have been described concerning a process cartridge having the photoconductive unit 110 and the developing unit 120 which are integrally combined, the present invention is not limited by a structure of the process cartridge. It will be apparent to those skilled in the art that the electrophotographic type image forming apparatus and its driving method according to the present invention can also adapt to an image forming apparatus and its driving method in which the photoconductive unit and the developing unit are separated from each other.

While, in the aforementioned embodiments of the present invention, a single motor 130 operates the photoconductive unit 110 and the developing unit 120 simultaneously, and the interrupting element 140 intercepts driving force delivered to the developing unit 120 selectively, the image forming apparatus according to the present invention is not limited by the aforementioned embodiments. For instance, when a first motor for operating the photoconductive drum 10 and a second motor for operating the developing unit 120 are provided, it is possible to implement the driving method according to the present invention by controlling a driving timing of the second motor.

An electrophotographic type image forming apparatus and its driving method according to the present invention has the following advantages by reducing the operating time of a developing unit as greatly as possible.

First, it is possible to minimize deterioration in characteristics of toner and each component of the developing unit, Secondly, it is possible to reduce the variation of toner consumption depending on accumulation of printing amount, Thirdly, it is possible to prolong the durability of a process cartridge by reducing toner consumption, and Fourth, it is possible to improve the print quality of an image.

While the present invention has been described with reference to exemplary embodiments thereof, it will be understood by those skilled in the art that various changes in form and details may be made therein without departing from the scope of the present invention as defined by the following claims.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A driving method of an image forming apparatus, the method comprising:

providing a photoconductor, an exposure unit which forms an electrostatic latent image on the photoconductor, a developing unit which faces the photoconductor and forms a developing area for supplying toner to the electrostatic latent image, and a transferring unit which faces the photoconductor and forms a transfer area;

performing a pre-rotation process to prepare for an image formation before starting to form an image, forming the electrostatic latent image by operating the exposure unit;

developing the electrostatic latent image by operating the developing unit; and transferring the developed image to a paper by supplying the paper to the transfer area when a leading end of the developed image reaches the transfer area, wherein the developing unit is not operated during the pre-rotation process, delivering motor force of a developing motor to the developing unit is stopped after a tail end of the electrostatic latent image passes through the developing area, the developing unit comprises a developing roller which directly faces the photoconductor, and the developing roller is stopped when delivering motor force of a developing motor to the developing unit is stopped.

2. The driving method of claim 1, wherein the developing roller has a higher peripheral velocity than the photoconductor.

3. The driving method of claim 2, wherein a peripheral velocity of the developing roller is approximately 1.05 to 1.5 times greater than the photoconductor.

4. The method of claim 2, wherein the developing roller does not rotate during the pre-rotation process.

5. The method of claim 1, wherein the pre-rotation process comprises removing a toner remaining on an outer circumferential surface of the photosensitive drum while the photosensitive drum is rotating.

6. The method of claim 5, wherein the pre-rotation process further comprises determining an optimum transfer bias to transfer the developed image to the paper by applying voltage to the transfer unit and measuring current flowing through the transfer area to the photosensitive drum.

* * * * *